United States Patent [19]

Gottlieb

[11] 4,180,278

[45] Dec. 25, 1979

[54] SKATEBOARD

[75] Inventor: Clifford C. Gottlieb, Sherman Oaks, Calif.

[73] Assignee: Sport-Fun, Inc., Los Angeles, Calif.

[21] Appl. No.: 912,434

[22] Filed: Jun. 5, 1978

[51] Int. Cl.[2] ..... A63C 17/00

[52] U.S. Cl. ..... 280/87.04 A; 280/11.28

[58] Field of Search ..... 280/87.04 A, 87.04 R, 280/11.28, 11.27, 11.19

[56] References Cited

U.S. PATENT DOCUMENTS

| | | | |
|---|---|---|---|
| 311,936 | 2/1885 | Wisewell | 280/11.28 |
| 616,773 | 12/1898 | Daniels | 280/11.28 |
| 2,763,490 | 9/1956 | Crone | 280/11.28 |
| 3,161,415 | 12/1964 | Novara | 280/11.28 |
| 3,331,612 | 7/1967 | Tietge | 280/87.04 A |
| 3,870,324 | 3/1975 | Balstad | 280/11.28 |
| 4,061,350 | 12/1977 | Schmidt, Jr. et al. | 280/11.28 |
| 4,071,256 | 1/1978 | Kimmell | 280/87.04 A |

FOREIGN PATENT DOCUMENTS

| | | | |
|---|---|---|---|
| 2210997 | 9/1973 | Fed. Rep. of Germany | 280/11.28 |

*Primary Examiner*—David M. Mitchell

*Attorney, Agent, or Firm*—Ellsworth R. Roston

[57] ABSTRACT

A skateboard including a platform, at least one flange member extending from the bottom of the platform, the flange member including an opening extending into the flange member and also including a recessed portion, a wheel support member for supporting a shaft member and wheel members at opposite ends of the shaft member, the wheel support member including a post extending outwardly and also including a recessed portion and with the post of the wheel support member received within the opening of the flange member for mounting the wheel support member on the flange member and with the recessed portions of the flange member and the wheel support member facing each other when the wheel support member is mounted on the flange member, and shock absorbing material located within the recessed portions for providing shock absorption between the wheel support member and the flange member.

17 Claims, 7 Drawing Figures

SKATEBOARD

The present invention is directed to a skateboard and specifically to a new structure for mounting the wheels at opposite ends of the board and with the structure of the present invention incorporating an integral shock mounting.

Skateboards presently being manufactured include a platform on which the rider of the skateboard stands. Supported below the platform at opposite ends of the platform are sets of wheels for allowing the rolling movement of the skateboard. Specifically, in some types of skateboards, each set of wheels is formed as a separate wheel assembly and with the two wheel assemblies bolted to the bottom of the platform at opposite ends of the platform.

One popular type of skateboard design incorporates a platform constructed of a molded plastic. Integrally molded on the lower surface of the platform at opposite ends of the platform are supports for receiving wheel assemblies. Each wheel assembly normally includes a metal shaft and metal strut members which interconnect with the integrally molded portions on the lower surface of the platform. The strut members may incorporate doughnut type shock mountings. One method of attaching each wheel assembly to the lower surface of the platform is to incorporate within the molded portions on the lower surface of the platform metal nut members which receive metal bolt members which are part of the wheel assemblies.

With the prior art skateboards described above, the wheel assembly represents a substantial portion of the cost of the skateboard. In addition, the wheel assembly is relatively complex and includes a large number of parts. Also the method of attachment of the wheel assembly to the platform is a relatively cumbersome procedure and again increases the cost of the finished product. The present invention is directed to a skateboard including a simpler structure for mounting the wheels to the bottom surface of the platform. The present invention essentially eliminates the type of expensive wheel assembly used in the prior art skateboards and greatly reduces the number of metal parts. For example, the present invention does not include metal strut members and is constructed entirely of plastic members with the exception of the wheel shaft and wheel bearings.

The present invention includes integrally molded flange members extending downwardly from the lower surface of the platform. Each flange member includes an elongated opening to receive a post member and a recess to receive resilient material for providing for shock absorption. Wheel support members are constructed of plastic similar to that used for the construction of the platform. Each wheel support member includes a post which is received within the elongated opening in one of the flanges. Each wheel support member also includes a complementary recess portion for supporting the shock absorbing material. The metal wheel shaft passes through an opening in the wheel support member and the wheels themselves and the bearings are similar to those present in the prior art.

The present invention provides for shock absorption through the use of a block of resilient material located within the complementary recesses in each one of the wheel support members and each one of the flanges. Additionally since the interconnection between each wheel support member and each flange is through the post received in the opening in the flange and since both the post and the material surrounding the opening are made of a molded plastic, this provides for an integral shock absorption between each wheel support member and its complementary flange.

The present invention also includes one method of construction wherein the assembly of the wheel support members and the flange portions of the platform occur shortly after the platform is removed from a mold and when the platform and its flange portions are still hot and in an expanded state. The post of the wheel support member includes at least one enlarged portion and the post is forced into the opening in the flange and with the opening including at least one groove complementary to the enlarged portion. As the flange portion cools it contracts and the groove locks around the enlarged portion of the post member so as to interlock the post member within the opening in the flange portion. The block of resilient material used to provide for shock absorption may be positioned within the complementary recesses prior to the completion of the insertion of the post into the opening.

In another method of construction of the present invention, the opening in the flange includes at least one groove and with the post including at least one enlarged portion and with the post forced through the opening to temporarily distort the opening and then to interlock the enlarged portion of the post within the groove in the opening.

The present invention also includes the use of a pin member which passes through the openings in the flange and the post to further lock the post within the flange. Additionally, the openings in the flange may be elongated in a direction to allow for a limited amount of twisting of the post relative to the flange. This twisting allows for the wheel assembly to twist to provide for directional control for the skateboard rider.

The skateboard of the present invention thereby provides for a simpler construction and manufacture than prior art skateboards and with the elimination of a large number of metal parts. In addition, the skateboard of the present invention incorporates shock absorption provided by shock absorption material such as a block of rubber contained within complementary recesses formed between the wheel support member and the flange. Additionally, the plastic-to-plastic contact between the wheel support and the flange member provides additional shock absorption.

A clearer understanding of the invention will be had with reference to the following description and drawings wherein FIG. 1 illustrates a perspective view of a skateboard constructed in accordance with the teachings of the present invention;

Figure 1:
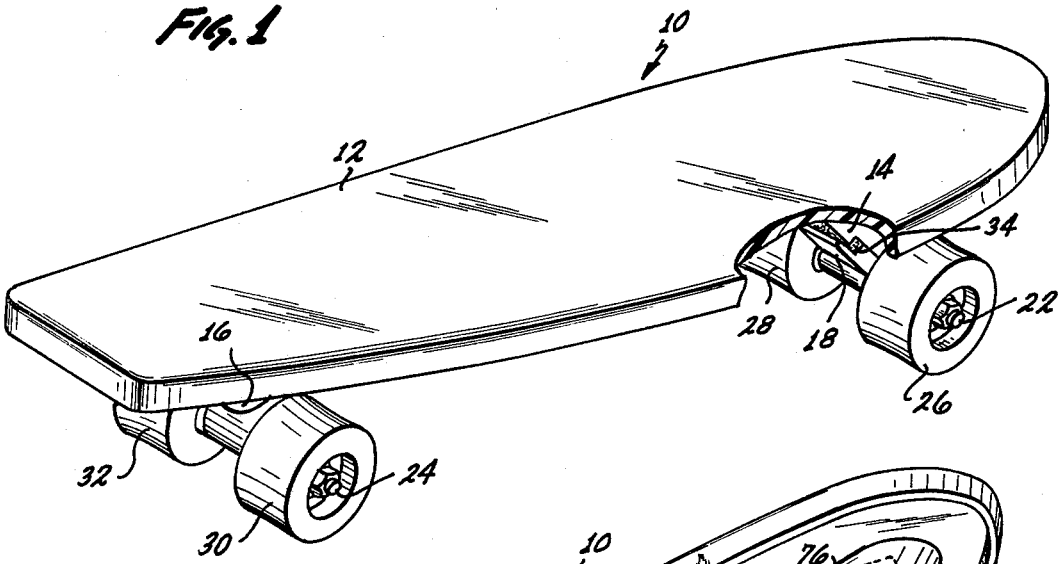
Figure 2:
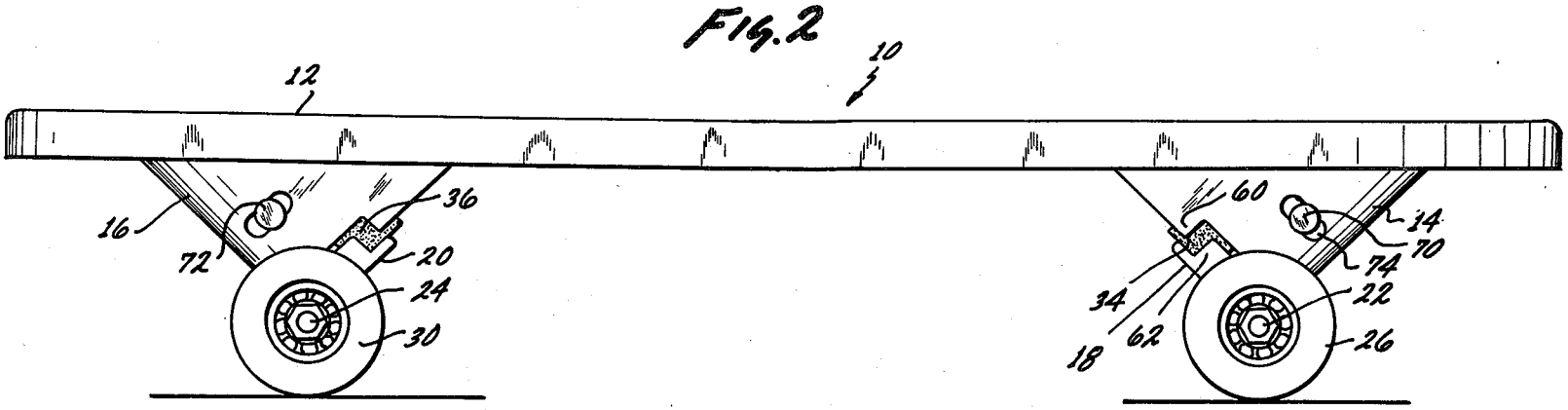
FIG. 2 illustrates a side view of the skateboard of FIG. 1.

In the drawings a skateboard 10 is shown and the skateboard 10 includes a platform 12. Extending from the bottom surface of the platform 12 are integral flange members 14 and 16. The integral flange members 14 and 16 extend downwardly from the bottom surface of the platform and are used to receive and support wheel support members 18 and 20 which in turn receive and support sets of wheels mounted at the end of a wheel shaft. Specifically wheel shaft members 22 and 24 pass through openings in the wheel support members 18 and 20 and with a pair of wheels supported for rotation at the ends of each shaft member. As shown in FIGS. 1 and 2, the shaft members 22 and 24 support a pair of wheels 26 and 28 on shaft member 22 and a pair of wheels 30 and 32 on shaft member 24. The wheels are shown to be supported at the ends of the shaft members using ball bearings but it is to be appreciated that any type of support means which allows for the free rotation of the wheels at the ends of the shaft may be used.

As shown in FIGS. 1 and 2, rubber shock absorbing means 34 and 36 are supported between the flange members 14 and 16 and the wheel support members 18 and 20. These shock absorbing means are actually received within complementary recesses in the flange and wheel support members. These shock absorbing means 34 and 36 may actually be constructed as solid rectangular blocks of resilient material such as rubber. As the skateboard is used and as various forces are produced between the wheels and the platform, the shock absorbing members 34 and 36 absorb shocks so that the upper surface of the platform 12 is more stable relative to the movements of the wheels. The shock absorbing material allows the wheels and specifically the axis along the shaft which supports the wheels to move more freely than the platform. The absorption of shock allows for a more stable ride for the skateboarder. The end faces of the flange members 14 and 16 intercept the bottom of the skateboard at transverse angles such as approximately 45°. This tends to equalize the forces from the movement of the wheels.

Figure 3:
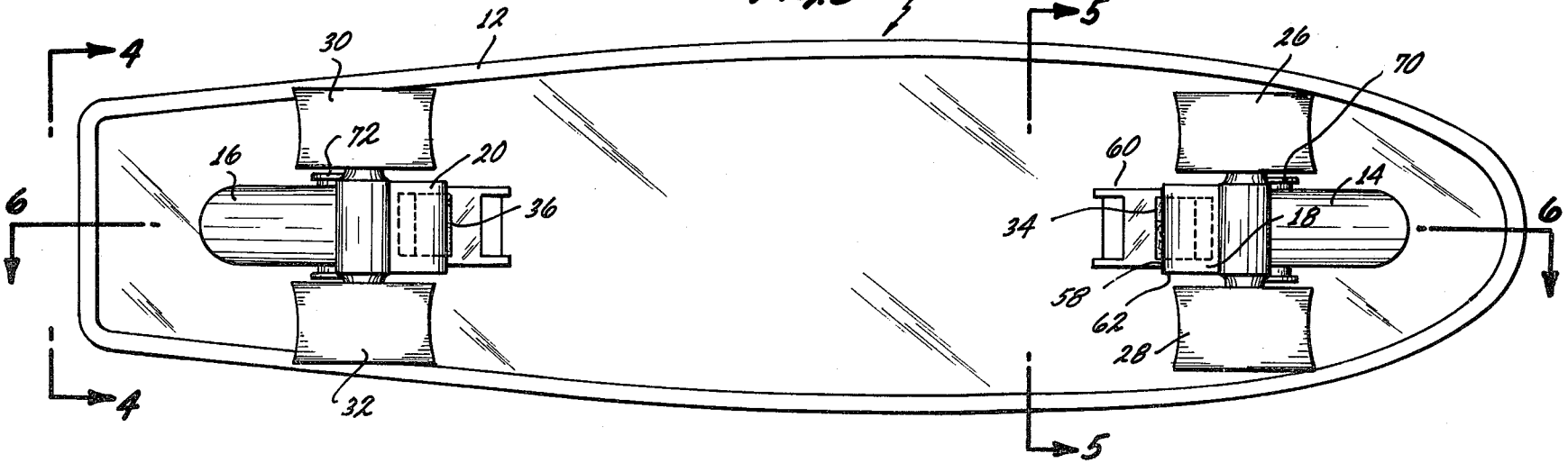
FIG. 3 illustrates a bottom view of the skateboard of FIG. 1.

FIG. 3 illustrates a bottom view of the skateboard 10 of the present invention and shows the above described arrangement of the various members constituting the skateboard of the present invention.

Figure 5:
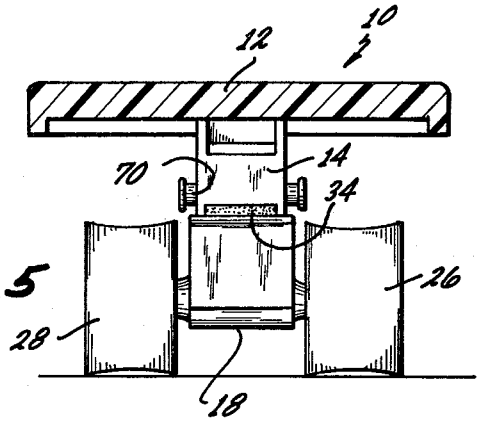
FIG. 5 illustrates a cross-sectional view of the skateboard of the present invention taken along lines 5—5 of FIG. 3.
Figure 4:
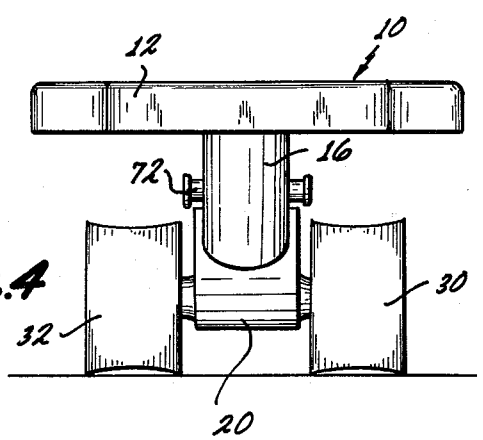
FIG. 4 illustrates an end view of the skateboard of the present invention taken along lines 4—4 of FIG. 3.

FIGS. 4 and 5 illustrate end views of the skateboard of the present invention with FIG. 5 being a cross-sectional end view. It can be seen that the flange members 14 and 16 extend downwardly from the bottom surface of the platform 12 and with the width of the flange members 14 and 16 being narrow in comparison with the width of the platform. The wheel support members 18 and 20 are also narrower in width than the width of the platform and with the wheel support members receiving the shaft members through openings to support the wheels 26 through 32 for rotation at the end of the shafts.

Figure 7:
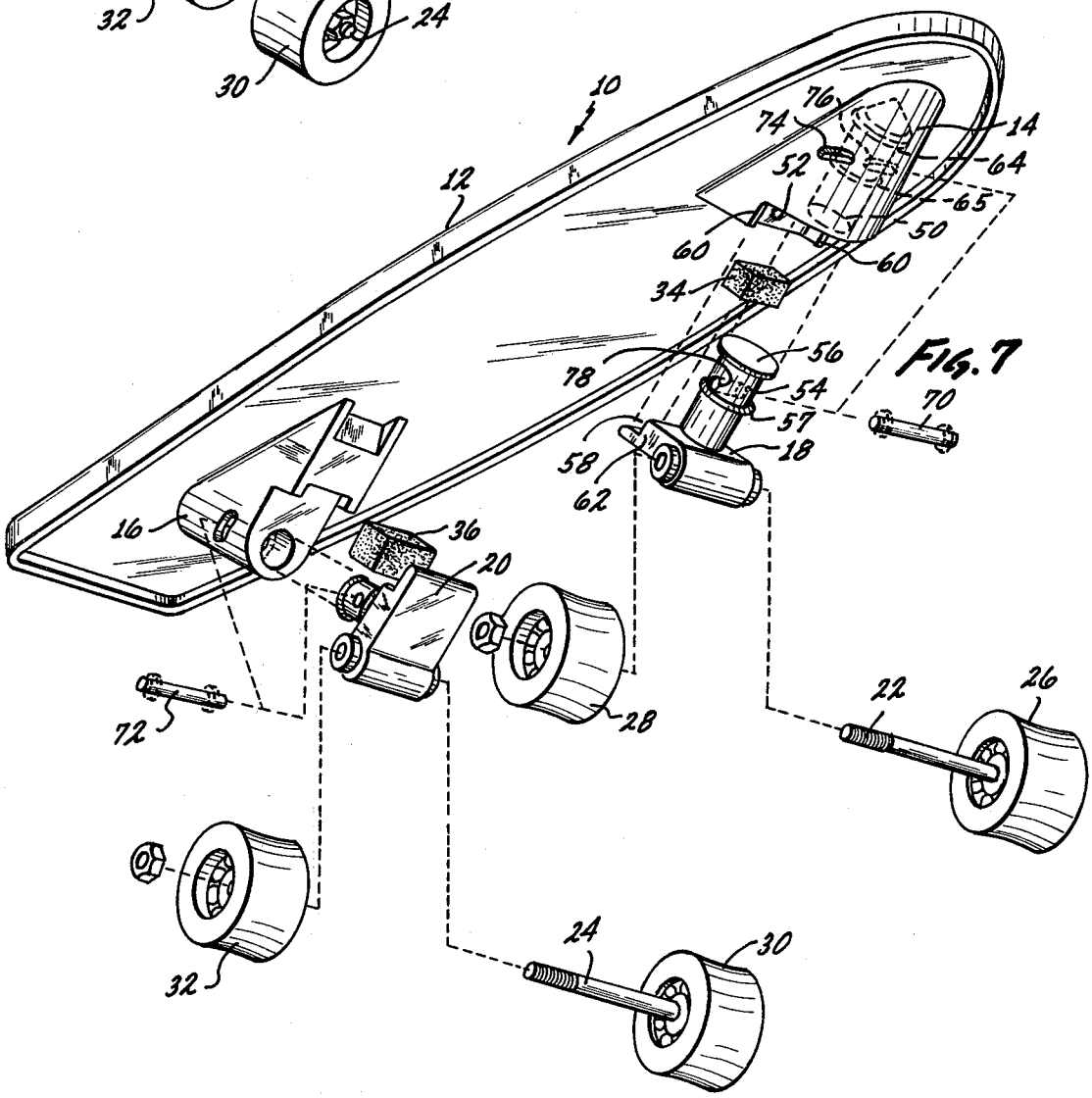
FIG. 7 illustrates an exploded view of the skateboard of the present invention which illustrates the various components and the method of manufacture.
Figure 6:
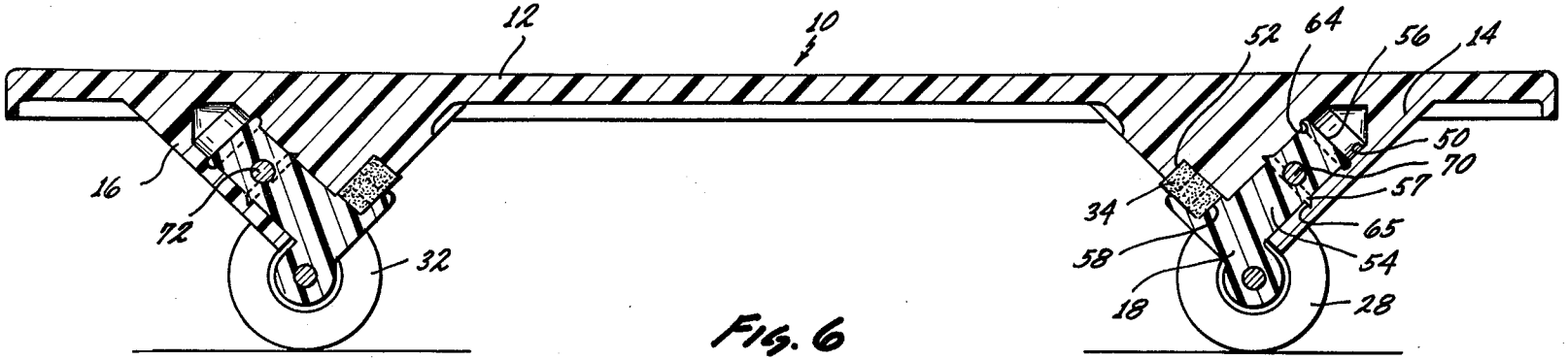
FIG. 6 illustrates a cross-sectional view of the skateboard of the present invention taken along lines 6—6 of FIG. 3.

FIGS. 6 and 7 illustrate in more detail the interrelationship between the wheel support members, the flange members and the shock absorbing members. FIG. 6 is a cross-sectional view and FIG. 7 is an exploded view. In FIGS. 6 and 7 it can be seen, using the flange 14 as an example, that an opening 50 extends in a first direction into and along a substantial portion of the flange 14 and along a substantially 45° angle. The flange 14 also includes a wall portion 52 removed from the opening in a second direction transverse to the first which is used to receive the shock absorbing member 34.

The wheel support member 18 includes an integral post member 54 having enlarged portions 56 and 57. The wheel support member 18 also includes a wall portion 58 removed from the post and displaced in the second direction from the wall portion 52 in the flange member. The shock absorbing material 34 is actually captured between the complementary wall portions 52 and 58. Specifically when the post 54 is interlocked within the opening 50, the shock absorbing material 34 is captured within the complementary recesses. As shown in FIG. 2, the flange 14 and the wheel support member 18 may include wall portions 60 and 62 which additionally capture the shock absorbing material 34 and prevent the shock absorbing material from working out of the recess. The other flange 16 and wheel support member 20 are similarly constructed to interlock in the same manner as described above and to capture the block of shock absorbing material 36.

As shown in FIGS. 6 and 7, the opening 50 includes grooves 64 and 65 which receive the enlarged portions 56 and 57 of the post 54. The grooves 64 and 65 may be formed in the opening 50 during the molding of the platform 12 with the integral flanges 14 and 16. During the assembly of the skateboards, the wheel support member 18 and specifically the post 54 is forced through the opening 50 to temporarily distort the material surrounding the opening 50 until the enlarged portions 56 and 57 interlock within the grooves 64 and 65. The shock absorbing material 34 would be positioned in the recesses before the post is forced completely into the opening.

A second method of interconnecting the post 54 within the opening 50 is to mold the platform and flange and specifically the opening 50 with the grooved portions 64 and 65. However, when the platform 12 with the integral flange members is initially removed from the mold, interior portions of the flange and specifically portions surrounding the opening 50 would still be hot and would be in an expanded state until the flange had cooled. Therefore, shortly after the platform 12 is removed from the mold and while it is still hot, the wheel support members such as member 18 would have its post member 54 inserted into the opening 50 to the position shown in FIG. 6. The block of shock absorbing member 34 would be positioned within the recesses prior to the post of the wheel support member being fully inserted. As the platform 12 and specifically as the flange portion 14 cools, the plastic material contracts to lock tightly around the post 54 and with the grooves 64 and 65 locking around the enlarged portions 56 and 57 of the post 54. This provides for a very strong interlocking of the post 54 within the opening 50.

It is also to be appreciated that the post 54 is constructed of a plastic material and therefore the post 54 within the opening 50 provides for a shock absorption between the wheels and the platform 12. In addition, the shock absorbing material 34 and 36 provides even a further degree of shock absorption between the wheels and the platform 12. This produces a relatively smooth ride at the upper surface of the platform 12 even while the wheels maneuver over relatively rough surfaces.

In order to insure that the wheel assemblies and specifically the posts cannot be pulled out of the flanges, the present invention also includes the use of pins 70 and 72 to additionally interlock the posts and flanges. Specifically pin 70 passes through elongated spaced openings 74 and 76 in flange 14 and through opening 78 in post 54. Similarly, pin 72 passes through elongated spaced openings in flange 16 and through an opening the corresponding post. The use of elongated openings through opposite sides of the flanges allows for a limited twisting of the posts in the flanges. This also allows for the wheel assemblies to twist so that the rider can provide directional control to the skateboard.

The present invention therefore provides for a skateboard having flange members extending downward for receiving post portions of wheel supporting members and with the flange portions integrally molded on the bottom surface of the platform of a skateboard and with the wheel supporting members also molded from similar plastic material. Shock absorbing means are captured between recesses in the flange portion and the wheel supporting members and with wheel shafts passing through openings in the wheel supporting means and supporting wheel members at ends of the wheel shafts. The present invention provides for a relatively simple structure which is easy to manufacture and which is inexpensive in cost yet still provides for the proper operation of the skateboard.

Although the invention has been described with reference to particular embodiments, it is to be appreciated that various adaptations and modifications may be made and the invention is only to be limited by the appended claims.

I claim:

1. A skateboard including a platform, at least one flange member extending from the bottom of the platform, the flange member including an opening extending into the flange member in a first direction and also including a recess extending in a second direction transverse to the first direction, said recess in said flange member being at least partially defined by a wall portion located at a position removed from said opening a pair of wheels, a shaft member, a wheel support member for supporting the shaft member and the pair of wheels at opposite ends of the shaft member, the wheel support member including a post extending outwardly and also including a recess facing the recess in the flange member said recess in said wheel support member being at least partially defined by a wall portion in displaced relationship in the second direction to the wall portion in the flange member and between the wall portions in the flange member and said post, the post of the wheel support member being received within the opening in the flange member in interlocking relationship with the opening in the flange member for mounting the wheel support member on the flange member, and shock absorbing material located within the recesses in constrained relationship between the wall portions for providing shock absorption between the wheel support member and the flange member, the pair of wheels being rotatably supported by the wheel support member at opposite lateral ends of the wheel support member.

2. The skateboard of claim 1 wherein the platform and flange member are molded as a unitary member.

3. The skateboard of claim 1 wherein the flange member, the wheel support member, the shock absorbing material and the pair of wheels are provided at one end of the platform and another flange member, wheel support member, shock absorbing material and pair of wheels are provided at the opposite end of the platform in a relationship corresponding to that between the first flange member, the first wheel support member, first shock absorbing material and the first pair of wheels.

4. The skateboard of claim 1 wherein the post includes at least one enlarged portion and wherein the opening includes at least one recess to receive the enlarged portion to interlock the post within the opening.

5. The skateboard of claim 1 wherein the flange member includes two downwardly exposed end faces forming substantially transverse angles with the bottom of the skateboard and the opening extends parallel to one of the end faces of the flange member and the recess extends along the other of the end faces of the flange member.

6. The skateboard of claim 1 additionally including additional openings in the flange member and a pin member passing through the additional openings in the flange member and the post to interlock the post within the flange member.

7. A skateboard including a platform made from a plastic material and including integral flange members extending downwardly from the bottom surface of the platform at opposite ends of the platform, each of the flange members including an opening extending upwardly through the flange member toward the platform, wheel support members made from a plastic material, each of the wheel support members including an integral post extending upwardly into the opening in an associated one of the flange members in an interlocking relationship with the flange member for mounting the wheel support member on the flange member, means for interlocking the posts within the openings in the flange members, and shock absorbing material supported by each of the flange members and the associated wheel support member at a position removed from to the post.

8. The skateboard of claim 7 wherein the means for interlocking includes at least one enlarged portion on each post and at least one recess in the opening in complementary relationship with the enlarged portion of each post for interlocking the enlarged portion within the recess.

9. The skateboard of claim 7 wherein the flange members include two downwardly exposed end faces forming substantially transverse angles with the bottom of the skateboard and wherein each opening extends parallel to one end of each of the flange members and the shock absorbing material extends along the other end of each flange member.

10. The skateboard of claim 7 additionally including a recess defined by each associated pair of flange member and wheel support member, the shock absorbing material being located in the recess between each pair of flange member and wheel support member.

11. The skateboard of claim 7 wherein a pin extends through each pair of flange member and the associated post.

12. The skateboard of claim 7 additionally including additional openings in the flange members and the posts and pin members extended through such additional openings.

13. The skateboard of claim 10 wherein the shock absorbing material is disposed in constrained relationship in each recess.

14. A skateboard including a platform, at least one flange member extending from the bottom of the platform, the flange member including an opening extending into the flange member and also including a recessed portion, a wheel support member for supporting a shaft member and wheel members at opposite ends of the shaft member, the wheel support member including a post extending outwardly and also including a recessed portion and with the post of the wheel support member received within the opening of the flange member for mounting the wheel support member on the flange member and with the recessed portions of the flange member and the wheel support member facing each other when the wheel support member is mounted on the flange member, and shock absorbing material located within the recessed portions for providing shock absorption between the wheel support member and the flange member, and additional openings in the flange member and a pin member passing through the additional openings in the flange member and the post to interlock the post within the flange member, the additional openings in the flange member being elongated to allow for limited twisting of the post and the wheel support member relative to the flange member.

15. The skateboard of claim 14 wherein the opening extends in a first direction and the recessed portion in the flange member extends in a second direction transverse to the first direction.

16. A skateboard including a platform molded from plastic material and including integral flange members molded on the bottom surface of and at opposite ends of the platform and with the flange members extending downwardly, the flange members each including an opening extending from a bottom surface of the flange and upwardly through the flange toward the platform, wheel support members molded from plastic material and with each wheel support member including an integral post extending outwardly and upwardly and with the post of each wheel support member received within the opening in one of the flange members for mounting the wheel support member on the flange member, and means for interlocking the posts with the openings in the flange members, shock absorbing material located between the flange members and the wheel support members, and the flange members and the wheel support members each including complementary recesses and the shock absorbing material is positioned within the recesses, and wherein the complementary recesses are rectangular and the shock absorbing material is a solid rectangle filling the recesses.

17. A skateboard including a platform molded from plastic material and including integral flange members molded on the bottom surface of and at opposite ends of the platform and with the flange members extending downwardly, the flange members each including an opening extending from a bottom surface of the flange and upwardly through the flange toward the platform, wheel support members molded from plastic material and with each wheel support member including an integral post extending outwardly and upwardly and with the post of each wheel support member received within the opening in one of the flange members for mounting the wheel support member on the flange member, and means for interlocking the posts within the openings in the flange members, and pin members each passing through additional openings in the flange members and the posts to interlock the posts within the flange members, and wherein the additional openings in the flange members are elongated to allow for limited twisting of the posts and the wheel support members relative to the flange members.

* * * * *